US005336868A

United States Patent [19]

Schluckebier

[11] Patent Number: 5,336,868

[45] Date of Patent: Aug. 9, 1994

[54] DEVICE FOR INDUCTIVELY HEATING FLAT METAL MATERIALS

[75] Inventor: Dieter Schluckebier, Simmerath, Fed. Rep. of Germany

[73] Assignee: Otto Junker GmbH, Simmerath, Fed. Rep. of Germany

[21] Appl. No.: 835,975

[22] PCT Filed: Aug. 27, 1990

[86] PCT No.: PCT/DE90/00654

§ 371 Date: Feb. 19, 1992

§ 102(e) Date: Feb. 19, 1992

[87] PCT Pub. No.: WO91/03916

PCT Pub. Date: Mar. 21, 1991

[30] Foreign Application Priority Data

Aug. 30, 1989 [DE] Fed. Rep. of Germany ..... 3928629

[51] Int. Cl.[5] ..... H05B 6/36

[52] U.S. Cl. ..... 219/675; 219/617; 219/672; 219/676

[58] Field of Search ..... 219/10.79, 10.75, 10.61 R, 219/10.71, 9.5, 672, 675, 676, 617

[56] References Cited

U.S. PATENT DOCUMENTS

| | | | |
|---|---|---|---|
| 2,722,589 | 11/1955 | Marquandt | 219/10.79 |
| 2,754,397 | 7/1956 | Albrecht | 219/10.79 |
| 3,424,886 | 1/1969 | Ross | 219/10.71 |
| 3,444,346 | 5/1969 | Russell et al. | 219/10.71 |
| 4,195,214 | 3/1980 | Gerber | 219/10.79 |
| 4,313,433 | 11/1968 | Timmermans et al. | 219/10.79 |
| 4,587,392 | 5/1986 | Claussé et al. | 219/10.71 |
| 4,694,131 | 9/1987 | Ino et al. | 219/10.41 |
| 4,778,971 | 10/1988 | Sakimoto et al. | 219/10.61 R |
| 4,788,394 | 11/1988 | Vannesle et al. | 219/10.61 R |
| 4,891,484 | 1/1990 | Waggott et al. | 219/10.61 R |
| 5,025,122 | 6/1991 | Howell | 219/10.71 |

FOREIGN PATENT DOCUMENTS

| | | |
|---|---|---|
| 0150793 | 9/1985 | European Pat. Off. . |
| 2573947 | 5/1986 | European Pat. Off. . |
| 0246660 | 11/1987 | European Pat. Off. . |
| 1158194 | 11/1963 | Fed. Rep. of Germany . |
| 1224345 | 9/1966 | Fed. Rep. of Germany . |
| 0593195 | 10/1947 | United Kingdom . |

*Primary Examiner*—Bruce A. Reynolds
*Assistant Examiner*—TU Hoang
*Attorney, Agent, or Firm*—Staas & Halsey

[57] ABSTRACT

A device for inductively heating flat metal objects, with at least one pair of induction coils which form a gap through which the object is moved. The induction coils have an iron core made up of transformer stampings with grooves in which current conductors are arranged. The iron cores of at least one inductor coil have grooves which run in a zig-zag or undulating fashion along the direction of motion of the object being heated. The maximum angle the grooves make with the direction of movement of the object is 60°, and the current conductors are disposed in the grooves so as to follow the zig-zags or undulations thereof. The inductor coils of at least one inductor-coil pair include several side-by-side conductors which are arranged so as to carry current in the same direction along the coil. At least some of the current conductors are arranged for selective independent electrical connection to a source of electrical energy.

9 Claims, 3 Drawing Sheets

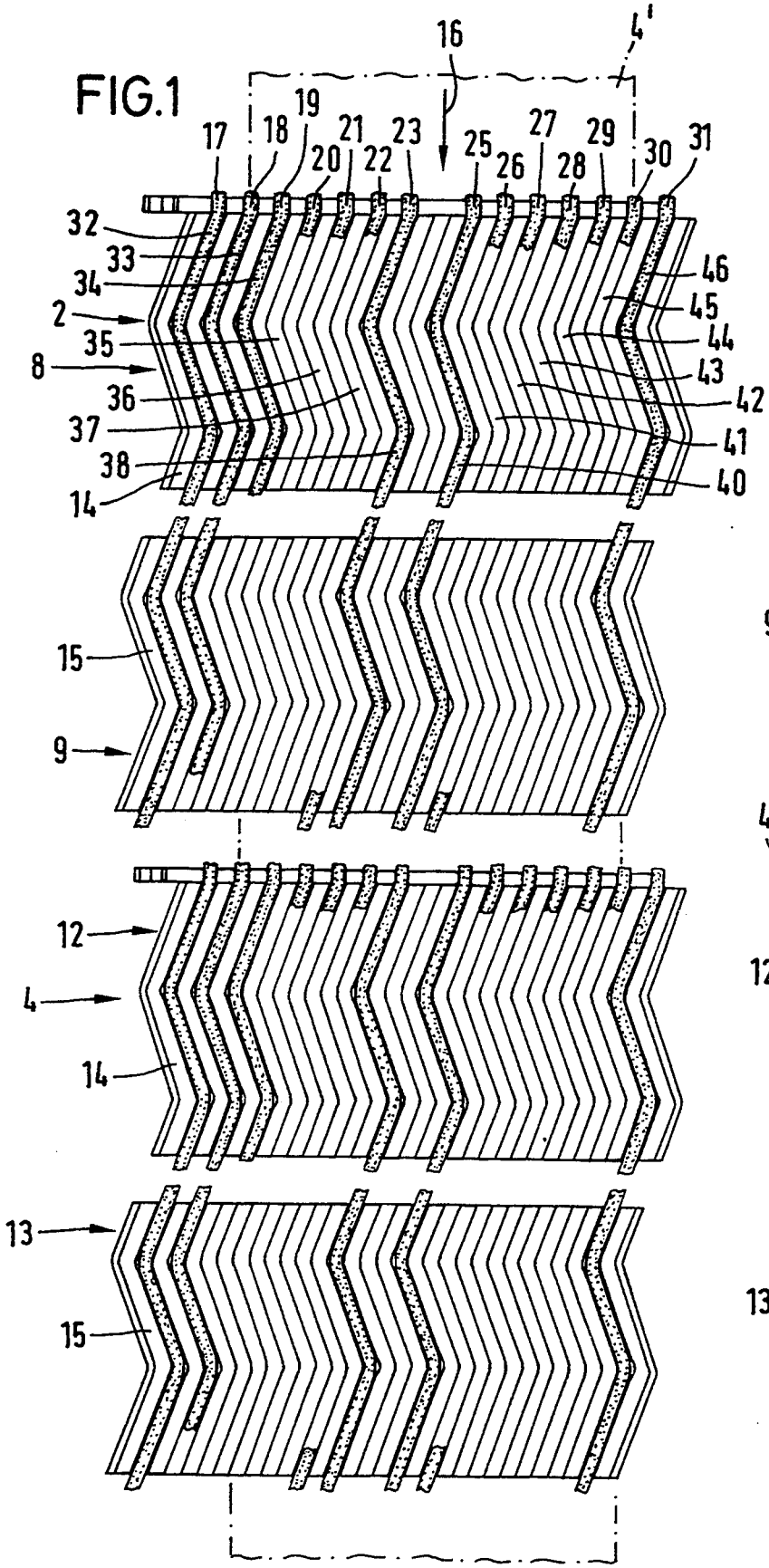
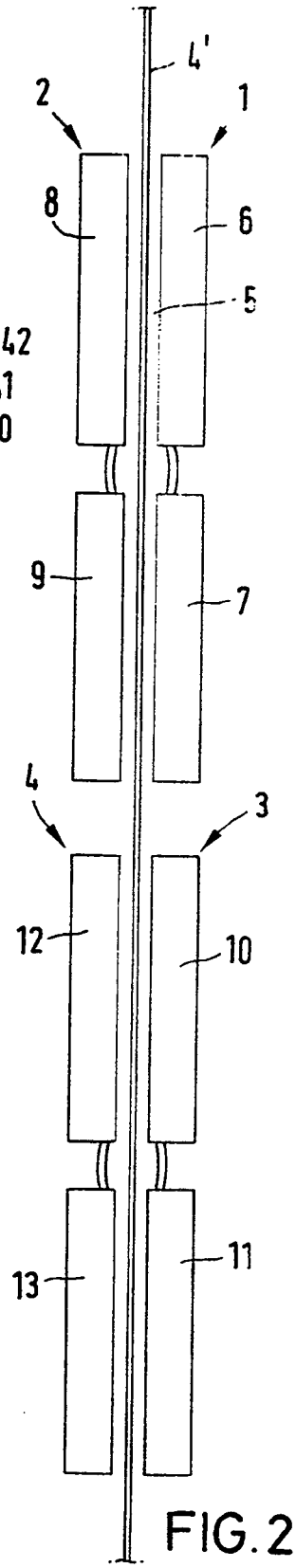
FIG.2

DEVICE FOR INDUCTIVELY HEATING FLAT METAL MATERIALS

BACKGROUND OF THE INVENTION

1. Field of the Invention

The invention relates to a device for inductively heating flat metal materials, e.g. strips and plates, with at least one pair of induction coils which form a gap through which the material can pass, whereby the induction coils have an iron core made up of transformer stampings with grooves in which current conductors are located, at least some of which can be switched independently.

2. Description of Related Art

Each induction coil consists of an iron core with a series of grooves in which the current conductors of the induction coils are embedded. These current conductors run crossways to or in the direction of motion of the material. Uniform heating across the entire width of the material is always a problem with this type of inductive heating device, in particular when the device is required to work with materials of various widths.

In order to provide better uniform heating of flat metal materials of various widths, EP-PS 0 150 793 proposes that the induction coil be divided into several induction coil sections arranged side-by-side in a longitudinal direction, each with its own induction winding and its own magnetic field. The distance of the induction coil sections from one another can be altered or adjusted to comply with various material widths. In addition, electrical means are provided to control the electrical current intensity in the induction coil windings. Adjustment to suit various material widths is by means of switching the outermost induction coil sections on or off. This known device allows adjustment of the heating energy to suit various material widths. However, because of the large number of induction coil sections arranged separately from one another, assembly of the device is extremely time consuming. In addition, the almost square spools result in large pole widths which are unfavourable in terms of temperature distribution.

A further disadvantage of this known device is a poor groove filling factor. In addition, the conductor sections running vertically to the direction of transport cause overheating of the edges of the material. Exact adjustment to the width of the material is not possible. Relatively high heating of the iron core sections is also unavoidable, as conductor sections run parallel to the iron core layers.

In DE-PS 884 811, an inductive heating device for the uniform heating of flat metal materials is described which has two or more inductive heat conductors arranged one behind the other in the direction of motion and curved in an undulating fashion, which are located singly or in multiple form staggered in relation to one another. An essential disadvantage of this known device lies in fact that although uniform heating may be achieved for one particular width of material, a satisfactorily uniform heating of other widths of material is no longer possible.

SUMMARY OF THE INVENTION

The task of the present invention consists in designing a device of the kind described above in such a way that the disadvantages of the known devices of this type are avoided and that various widths of material can be heated uniformly over the entire width, whereby the induction coils are simple to assemble.

This task is solved in accordance with the invention by a device of the kind described above in that the iron cores of at least one induction coil have grooves which run in a zig-zag or undulating fashion in the direction of motion of the material, and that the maximum angle these grooves make with the direction of motion of the material is 60°, the current conductors in the grooves follow the grooves, and the induction coils of at least one induction coil pair have several current conductor arranged side-by-side which carry current in the same direction.

The current conductors running in a zig-zag or undulating fashion in the direction of motion in the correspondingly-arranged grooves of the iron core ensure that the length of time for which a current conductor acts on the section of material to be heated which it covers is uniform, so that uniform heating occurs in this sector. The zig-zag or undulating pattern provides particularly advantageous possibilities for arranging adjacent current conductors in a particularly equally distributed manner. The corners or curves of current conductors shaped in this way can fit into corresponding spaces left by adjacent current conductors and be offset in relation to them. This kind of uniform arrangement cannot be used in particular for such known current conductors as are made up of conductor sectors running essentially at right angles to one another.

Since the current conductors can be switched independently, overheating in the peripheral areas of the material can be avoided and thus uniform heating over the entire width of the material can be achieved.

The device in accordance with the invention can also be designed in such a way that the current conductors carrying current in the same direction have one conductor part in the direction of motion of the material and one in the opposite direction.

The device in accordance with the invention can also be designed in such a way that the current conductors carrying current in the same direction and arranged adjacently to one another are arranged symmetrically about the longitudinal centre line of the induction coil. This particularly facilitates adjustment to various widths of material.

The device in accordance with the invention can also be designed in such a way that there is at least one current conductor in each groove of an iron core.

The device in accordance with the invention can also be designed in such a way that each induction coil has two mechanically separated induction parts arranged one behind the other, which have grooves for receiving current conductors. This kind of split induction coil allows staggering of the induction coil parts and thus facilitates further the uniform distribution of the heating. At the same time, the costs for this are less than for the use of two separate induction coils.

The device in accordance with the invention can also be designed in such a way that both induction coil parts are movable in relation to one another essentially crossways to the direction of motion of the material. This also renders the action of the current conductors and thus the heating of the material more uniform.

The device in accordance with the invention can also be designed in such a way that the pole width of the induction coils is adjustable.

The device in accordance with the invention can also be designed in such a way that the current conductor and/or several current conductors positioned at the edge of the material is or are electrically short-circuited with the current conductor next in the direction crossways to the direction of motion. This creates a damping winding also contributing to uniform heating.

The device in accordance with the invention can also be designed in such a way that when several induction coil pairs are used, each pair is connected with a separate current source with a different frequency in each case. The use of different, selected frequencies can also increase the uniformity of heating across the width of the material.

The device in accordance with the invention can also be designed in such a way that the current conductor or conductors located at the edge of the material is or are connected with a current source with a different frequency so that of the current conductors in the central area of the material. This is another way of increasing uniformity.

The device in accordance with the invention can also be designed in such a way that the longitudinal centre line of at least one induction coil is inclined by 3° to 6° against the direction of motion.

The device in accordance with the invention can also be designed in such a way that the iron core and the current conductors of one induction coil are arranged at an angle of 180° in relation to the iron core and current conductors of another induction coil.

Finally, the device in accordance with the invention can also be designed in such a way that the iron cores of a pair of induction coils are arranged in a staggered manner in relation to one another.

In the following part of the description some practical embodiments of the device in accordance with the invention are illustrated with the aid of drawings.

BRIEF DESCRIPTION OF THE DRAWINGS

FIG. 1 shows a schematic view of the side of the induction coil in accordance with the invention facing the material to be heated, FIG. 2 shows a side view of the device in accordance with FIG. 1.

DESCRIPTION OF THE PREFERRED EMBODIMENTS

Figure 3:
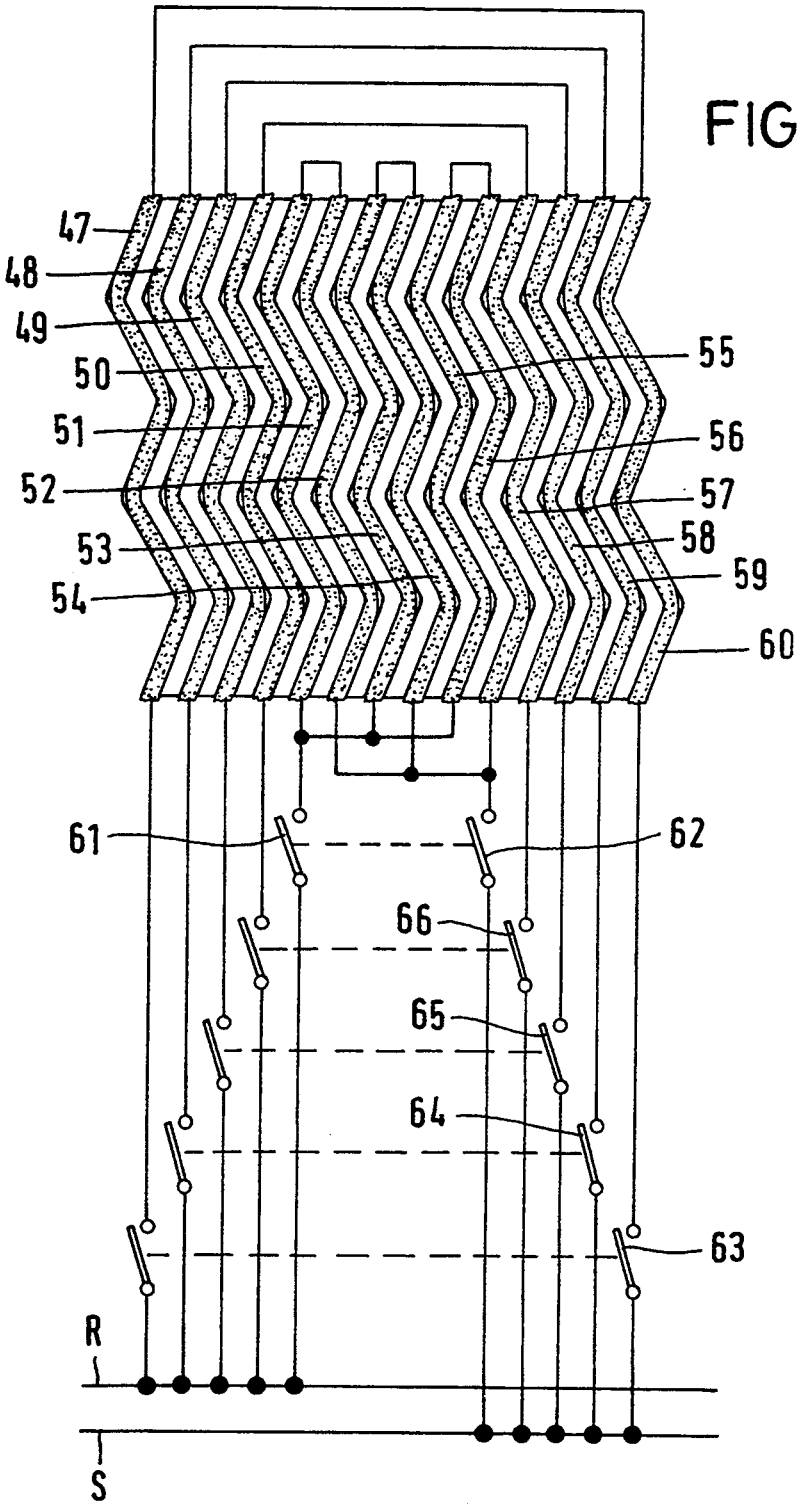
FIG. 3 shows a circuit diagram of the induction coil in accordance with the invention and FIG. 4 shows a further circuit diagram of the induction coil in accordance with the invention.

The practical embodiment of the device for inductive heating in accordance with the invention shown in FIGS. 1 and 2 has four induction coils 1,2,3,4. The induction coils 1 and 2 form a first pair of coils and the induction coils 3 and 4 make up another pair of coils. The induction coils of each pair are positioned on opposite sides of a strip-shaped material 4', which passes through a gap 5 between the induction coils of each pair. In the practical embodiment in accordance with FIGS. 1 and 2, the induction coils 1,2,3,4 are each divided into two induction coil parts 6,7; 8,9; 10,11; 12,13.

Since in the practical embodiment in accordance with FIGS. 1 and 2, the induction coils 1,2,3,4 are all of the same design, in the following description only the induction coil 2 will be described representative for all induction coils.

Each induction coil part 8,9 has an iron core 14,15. These iron cores 14,15 are provided with a series of grooves 17–23 and 25–31 running in a zig-zag fashion in the direction of motion of the material 4' indicated by the arrow 16. Current conductors 32–38 and 40–46 are arranged in these grooves, following the course of the grooves. The current conductors 32–38 and 40–46 are designed and arranged in the grooves 17–23 and 25–31 in the usual way. As a rule, the current conductors are provided with an inner cooling channel not illustrated here for the passage of a coolant. The space between the groove and the current conductor is filled with a suitable filling material, in order firstly to hold the current conductors in the groove reliably and secondly to ensure a good transfer of heat between the current conductor and the iron core, thus ensuring intensive cooling of the iron core.

In the practical embodiment in accordance with FIGS. 1 and 2, the induction coil parts 8,9 are offset in relation to one another crossways to the direction of motion 16 and can be shifted relatively to one another in this direction by known mechanical means, in order to alter this offset position. The current conductors are designed to be flexible in the area between the induction coil parts 8,9.

In the practical embodiment shown, the angle of the grooves 17–23 and 25–31 and thus also the angle of the current conductors 32–38 and 40–46 to the direction of motion 16 is approx. 15°.

In accordance with FIG. 1, the induction coil 4 with the induction coil parts 12,13 is laterally offset in relation to the induction coil 2 with the induction coil parts 8,9, in order to achieve a uniform, optimal temperature distribution in the material 4'.

In deviation from the practical embodiment shown, the induction coil 4 can also be provided with grooves and conductor loops running crossways to the direction of motion 16.

FIG. 3 shows an induction coil with current conductors 47 to 60. Each current conductor or each conductor loop consists of two conductor parts each embedded in one groove of the iron core. These conductor parts are electrically connected with each other at one end of the induction coil via cross connections, whereas at the other end of the induction coil they can each be connected via switches with a predetermined phase of an electric circuit RS.

In the practical embodiment shown, the three central current conductors 51 and 52, 53 and 54 as well as 55 and 56 can be connected with the electrical circuit via switches 61,62 which are operated in conjunction with one another. The other current conductors 47 and 60, 48 and 59, 49 and 58 as well as 50 and 57 can be connected with the electrical circuit RS independently of one another via switches 63 to 66.

In a switched-on condition, the outer current conductors 47 and 60, 48 and 59, 49 and 58 as well as 50 and 57 carry current in the same direction, so that overheating in the peripheral areas of the material 4' can essentially be ruled out.

Figure 4:
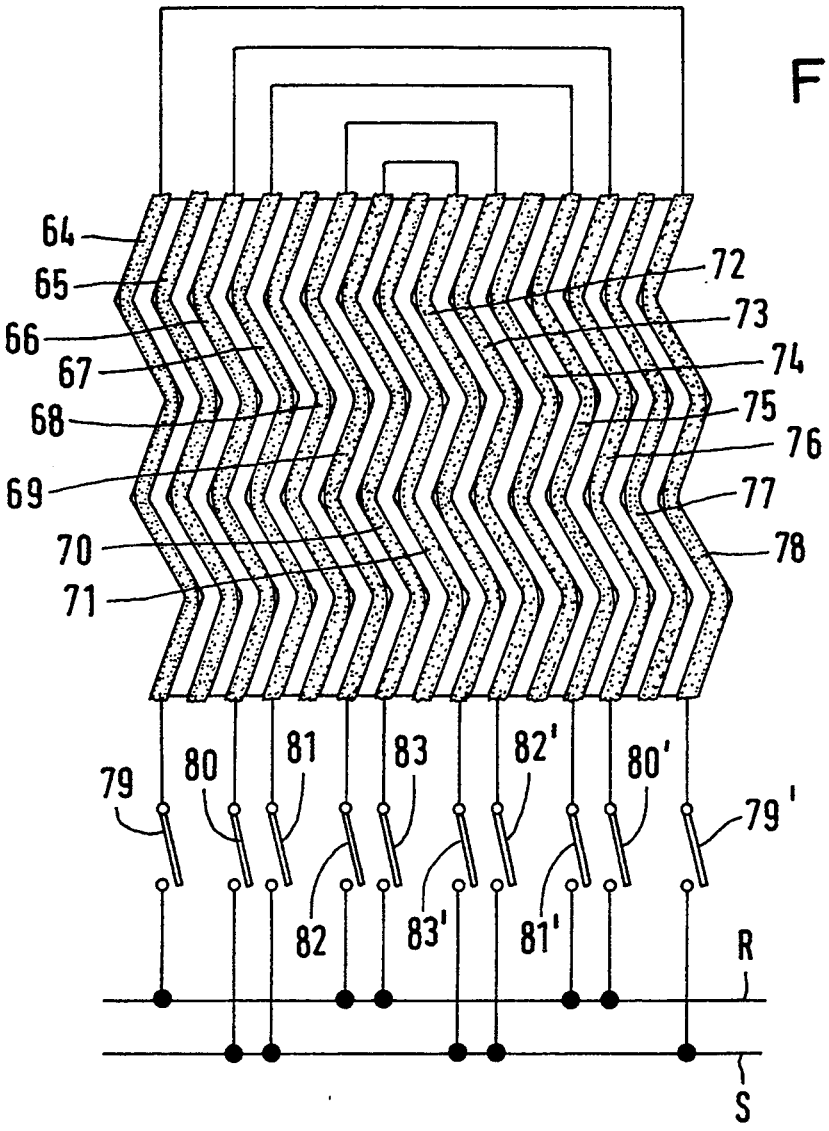

While switching of the current conductors in accordance with FIG. 3 is particularly expedient for a relatively large pole pitch, FIG. 4 shows a practical embodiment which is particularly expedient with grooves lying relatively close together and with current conductors 64 to 78 in the iron core. In the case of this practical embodiment, the induction coil has the active current conductors 64 and 78, 66 and 76, 69 and 73 as well as 70 and 72, which can be connected with the electrical circuit RS via the switches 79,79'; 80,80'; 81,81'; 82,82' and 83,83' in pairs and independently of one another and of the other conductors. The current conductors 65,68,71,74 and 77 are not used in this case. They are held in reserve for other switching arrangements.

In its various practical embodiments, the device described allows heating of flat metal materials of various widths in a uniform manner over the whole width by means of the zig-zag or wave-shaped course of the current conductors in connection with the fact that the individual conductor loops can be switched independently. Depending on requirements, the outer current conductors can be switched on or off in order to achieve the greatest possible evenness of temperature in the material to be heated.

I claim:

1. A device for inductively heating flat metal objects comprising:

at least one pair of induction coils which are spaced apart to present a heating gap therebetween through which an object to be heated is moved along a path of travel which extends laterally between said coils, each of said coils including an elongated iron core positioned to extend along said path of travel, each of said cores having a plurality of longitudinally extending grooves therein, the grooves in the iron core of at least one of said coils each having a plurality of segments disposed in a zig-zag or undulating configuration, said segments being disposed at respective angles not greater than 60° relative to said path of travel, said coils including a plurality of elongated, individually electrically connectable current conductors, each of said conductors being disposed within a respective groove to extend therealong.

2. A device as set forth in claim 1, wherein each of said coils have several of said conductors arranged in side-by-side relationship for carrying current in a same direction along said core.

3. A device as set forth in claim 2, wherein said cores have spaced ends and said several of said conductors each has a first part which carries current toward one end of the core and a second part which carries current toward a second end of the core.

4. A device as set forth in claim 2, wherein said several of said conductors are arranged symmetrically relative to a longitudinal center line of a respective coil.

5. A device as set forth in claim 1, wherein each of said coils comprises a pair of longitudinally spaced coil segments.

6. A device as set forth in claim 5, wherein said coil segments are individually laterally movable toward and away from said path of travel.

7. A device as set forth in claim 1, wherein said induction coils have an adjustable pole width.

8. A device as set forth in claim 1, wherein is included a side-by-side pair of said conductors, said pair of conductors being directly electrically connected in a direction which is lateral to the path of travel.

9. A device as set forth in claim 1, wherein one of said conductors is connected to a first source of electricity having a first frequency and a second of said conductors is connected to a second source of electricity having a second frequency.

* * * * *